US006698696B1

(12) United States Patent
Yang

(10) Patent No.: US 6,698,696 B1
(45) Date of Patent: Mar. 2, 2004

(54) STAND FOR SUPPORTING FRAMES OF A GOLF BAG

(76) Inventor: Fu-Hsiung Yang, 2nd Floor, No. 7, Chung-Long Lane, San-Ming Road, Sec. 2, Pan-Chiao (TW)

( * ) Notice: Subject to any disclaimer, the term of this patent is extended or adjusted under 35 U.S.C. 154(b) by 0 days.

(21) Appl. No.: 10/316,328

(22) Filed: Dec. 11, 2002

(30) Foreign Application Priority Data

Sep. 9, 2002 (TW) ..... 91214112 U

(51) Int. Cl.[7] ..... A63B 55/00
(52) U.S. Cl. ..... 248/96; 248/97
(58) Field of Search ..... 248/96, 97, 150, 248/167, 171, 434; 206/315.3, 315.7, 315.4

(56) References Cited

U.S. PATENT DOCUMENTS 5,339,951 A * 8/1994 Chen ..... 206/315.7
5,829,719 A * 11/1998 Han ..... 248/96
5,857,567 A 1/1999 Cheng ..... 206/315.7
5,901,845 A * 5/1999 Cheng ..... 206/315.7
6,220,433 B1 * 4/2001 Kang ..... 206/315.7
6,241,201 B1 * 6/2001 Wang ..... 248/96
6,325,208 B1 * 12/2001 Cheng ..... 206/315.7
6,435,345 B1 * 8/2002 Wang ..... 206/315.7
6,494,416 B2 * 12/2002 Wang ..... 248/96
6,581,767 B2 * 6/2003 Cheng ..... 206/315.7

* cited by examiner

*Primary Examiner*—Korie Chan
*Assistant Examiner*—A. Joseph Wujciak
(74) *Attorney, Agent, or Firm*—Patterson, Thuente, Skaar & Christensen, P.A.

(57) ABSTRACT

A stand for supporting frames of a golf bag includes an anchoring block, a pivot and an L-shape stand. The anchoring block has a flat portion further including a positioning nose. The flat portion has a pair of ear portions constructed at opposite sides thereof, and each of the ear portions has a pivotal hole. Also, the flat portion has a pair of rim fences located respectively outside to the ear portions. The L-shape stand has a pivotal pipe portion formed at one side and a hook formed at an opposite side. The pivot passes through the pivotal hole of one ear portion, die pivotal hole of the pivotal pipe portion, and the pivotal hole of another ear portion so that the L-shape stand can rotate freely about the anchoring block.

6 Claims, 14 Drawing Sheets

STAND FOR SUPPORTING FRAMES OF A GOLF BAG

BACKGROUND OF THE INVENTION (1) Field of the Invention

The invention relates to a golf bag, and more particularly to a stand structure of the golf bag which includes supporting frames.

(2) Description of the Prior Art

It is well known in the art that an improved golf bag can have supporting frames or legs. For instance, the "Golf bag" disclosed in Taiwanese Patent Publication No. 341868 is one of those improvements. However, a base of a conventional stand accompanying the supporting frames is usually obliquely shaped so that the base of the golf bag presents a respective slope (in particular, the inclined portion 133 in the cited publication). Upon such an arrangement, clubs inside the golf bag may slide automatically to a lowest portion with respect to the slope of the base. Thereby, the arrangement of clubs inside the golf bag may be messed and makes it difficult to pick a particular club.

Therefore, to design a simple-structured and convenient stand for supporting frames of the golf bag so that clubs can rest stably, without sliding arbitrarily, inside the golf bag becomes a crucial issue.

SUMMARY OF THE INVENTION

Accordingly, it is a primary object of the present invention to provide a simple-structured, and easy-to-manufacture and easy-to-assemble stand for supporting frames of a golf bag.

It is another object of the present invention to provide a stand for supporting frames of a golf bag which makes the pick and the accommodation of the clubs easily.

The stand for supporting frames of a golf bag in accordance with the present invention is pivotally constricted inside a concave portion formed at a rim of a base located at a lower portion of the golf bag. The supporting frames includes a plurality of oblique legs, a connecting bar and a link bar. The connecting bar can be a hollow-pipe structure for allowing the link bar to pass through thereinside and to stretch thereout at a top end thereof, at where the link bar extends to form a fork shape for further connecting with respective top portions of the oblique legs. Also, top ends of the oblique legs can be pivotally connected at a proper location at top of the golf bag.

The stand for supporting frames is characterized in that: the stand for supporting frames comprises an anchoring block, a pivot and an L-shape stand. The anchoring block has a flat portion with a positioning nose, and the flat portion further has a pair of ear portions constructed at opposite sides and a pair of rim fences located respectively outside to the pair of the ear portions. Each of the ear portions has a pivotal hole corresponding to each other. The L-shape stand has a pivotal pipe portion formed at one side and a hook formed at an opposite side. The pivot can pass through the pivotal hole of one ear portion, the pivotal hole of the pivotal pipe portion, and the pivotal hole of another ear portion so that the L-shape stand can rotate freely about the anchoring block. By providing the rim fences of the anchoring block to mate upwards and vertically with respective receiving grooves formed at a vertical surface of the concave portion, a positioning nose of the anchoring block can engage fixedly with an aperture located at the vertical surface. The stand can be fixed with the base and the link bar can engage with the hook. While in use, when the oblique legs of the supporting frames are expanded to drive the link bar and the stand hooked with the link bar, a simultaneous grounding state can be achieved by aligning an outer curve portion of the L-shape stand with a resting surface of the base.

Another aspect of the stand for supporting frames in accordance with the present invention is characterized in that: the rim fences of the anchoring block can mate inwards and horizontally with respective receiving grooves formed at a horizontal surface of the concave portion and a positioning nose of the anchoring block can engage fixedly with an aperture located at the horizontal surface. Thereby, the L-shape stand can be fixed with the base.

A further aspect of the stand for supporting frames in accordance with the present invention is characterized in that: the flat portion of the anchoring block has a hole and the vertical surface of the concave portion of the base has a corresponding hole. By using a screw set to pass through the hole of the anchoring block and the corresponding hole of the concave portion of the base, the anchoring block can be fixed onto the vertical surface and the L-shape stand can be fixed with the base.

One more aspect of the stand for supporting frames in accordance with the present invention is characterized in that: the flat portion of the anchoring block has a hole and the horizontal surface of the concave portion of the base has a corresponding hole. By using a screw set to pass through the hole of the anchoring block and the corresponding hole of the concave portion of the base, the anchoring block can be fixed onto the horizontal surface and the L-shape stand can be fixed with the base.

All these objects are achieved by the stand for supporting frames of a golf bag described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a stand for supporting frames of a golf bag. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention., Referring now to FIG. 1A through FIG. 5, a first embodiment of the stand for supporting frames of the golf bag in accordance with the present invention is-shown.

Figure 1A:
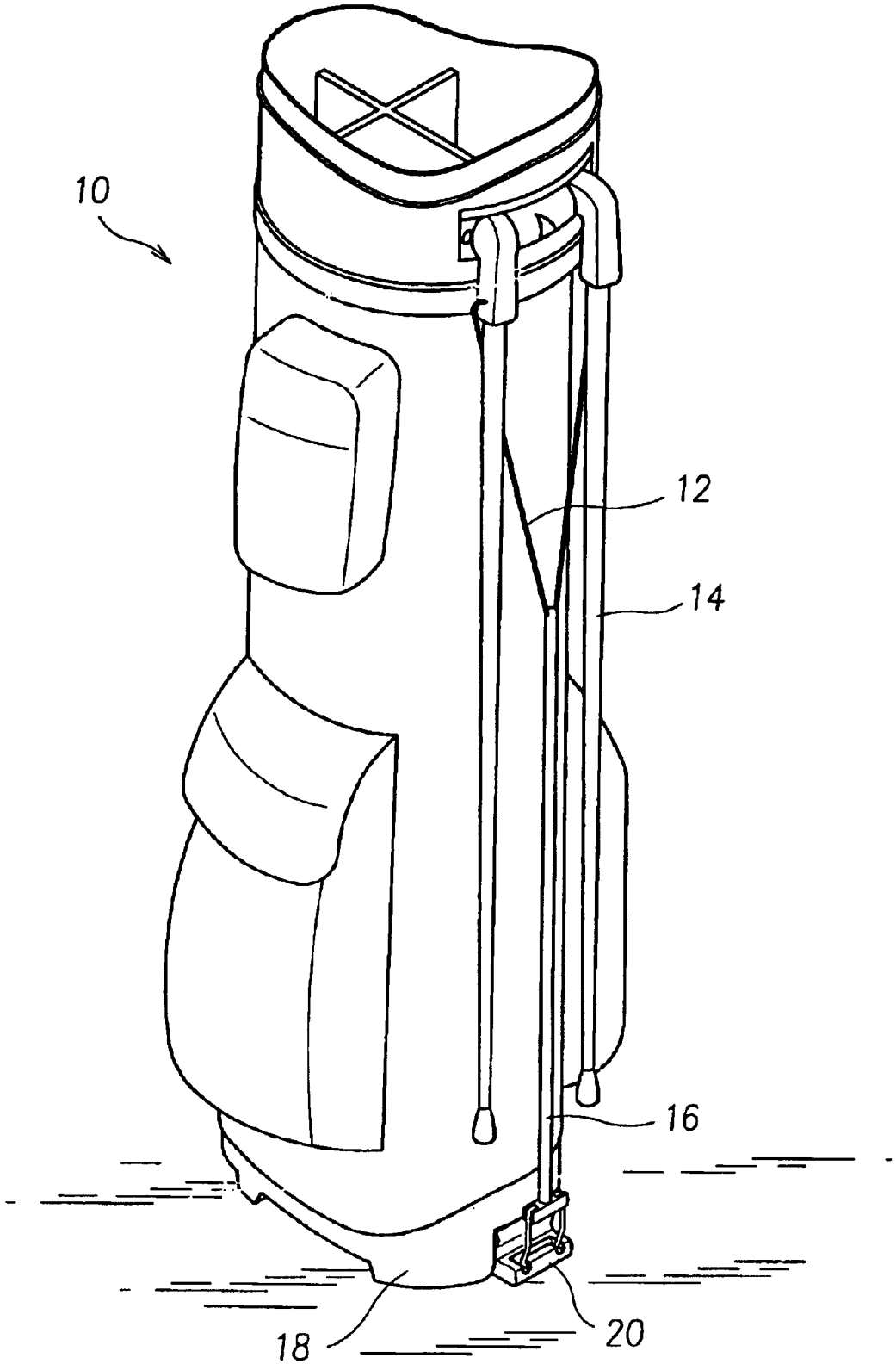
FIG. 1A is a schematic perspective view of a preferred golf bag in accordance with the present invention, posing an upright state.

The stand 20 for supporting frames of the golf bag 10 according to the present invention is pivotally constructed inside a concave portion 30 formed at a rim of a base 18 located at a lower portion of the golf bag 10. The supporting frames include mainly a plurality of oblique legs 14, a connecting bar 16 and a link bar 12. The connecting bar 16 is a hollow-pipe structure for allowing the link bar 12 to pass thereinside and to stretch thereout at a top end to form as a fork shape for further connecting with respective top portions of the oblique legs 14. As shown in FIG. 1A, top ends of the oblique legs 14 can be pivotally connected at a proper location at top of the golf bag 10.

Figure 1B:
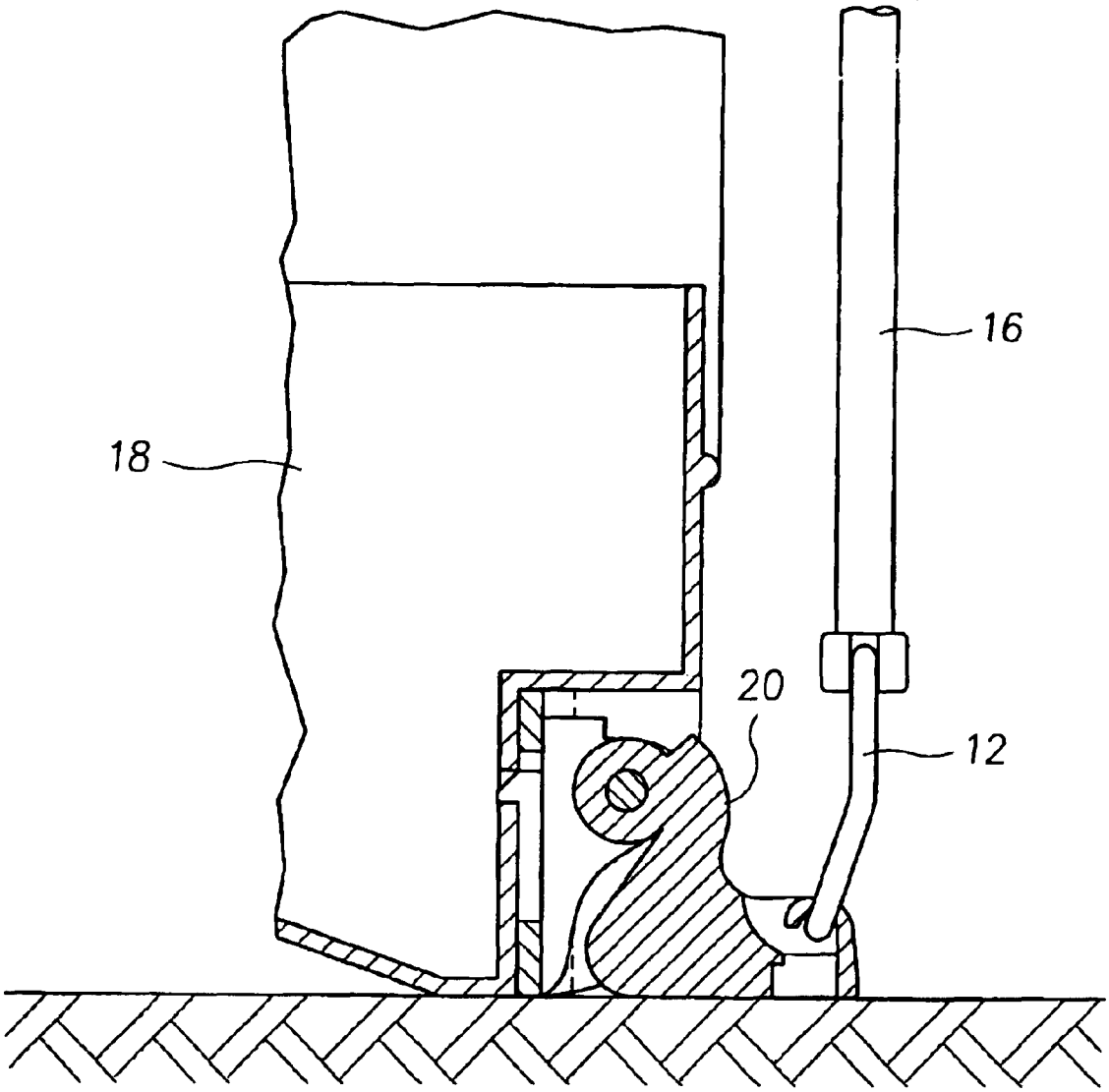
FIG. 1B is a partial cross-sectional view of FIG. 1A showing a lower portion of the golf bag.
Figure 2A:
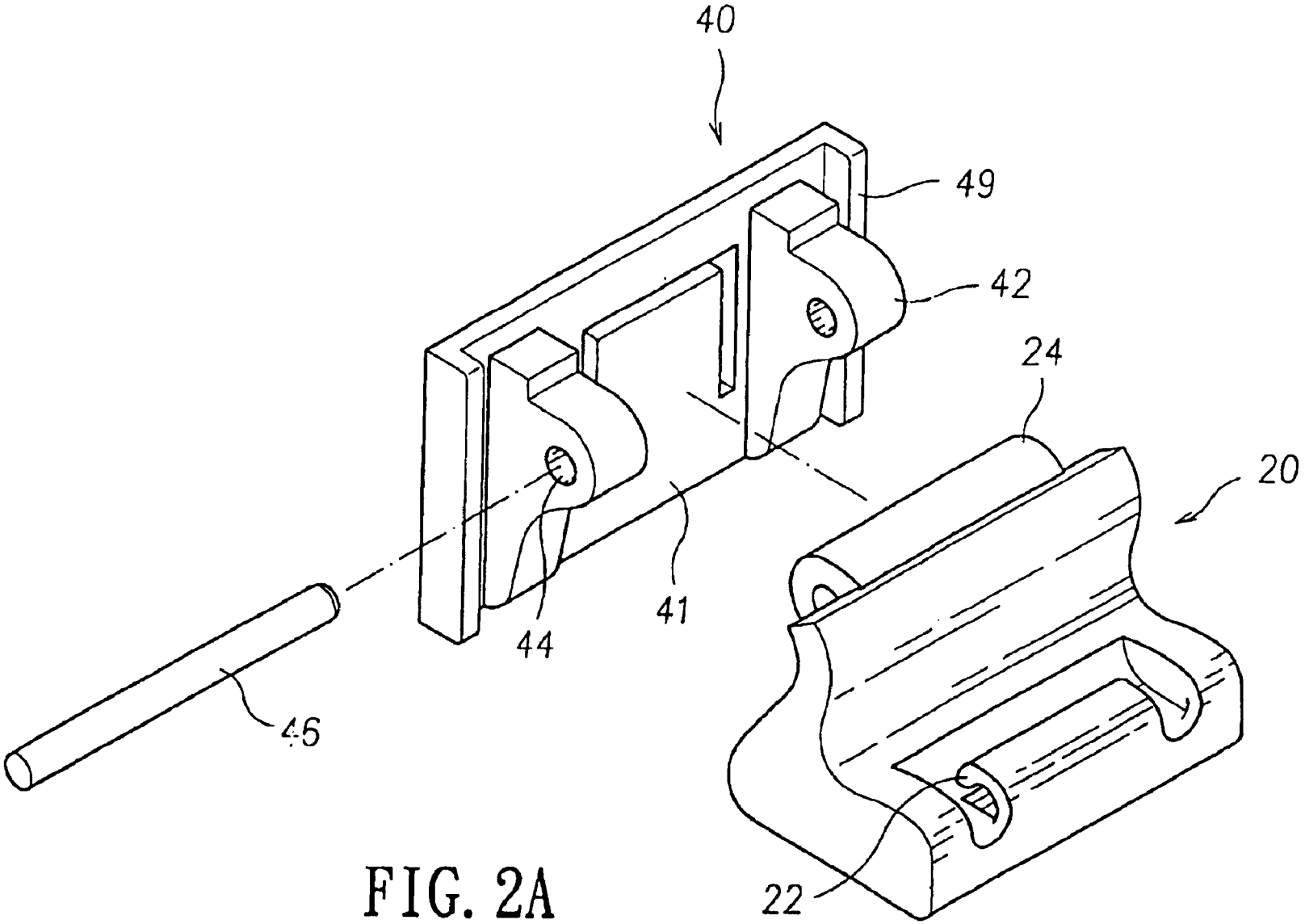
FIG. 2A is a exploded view of a first embodiment of the stand in accordance with the present invention.
Figure 2B:
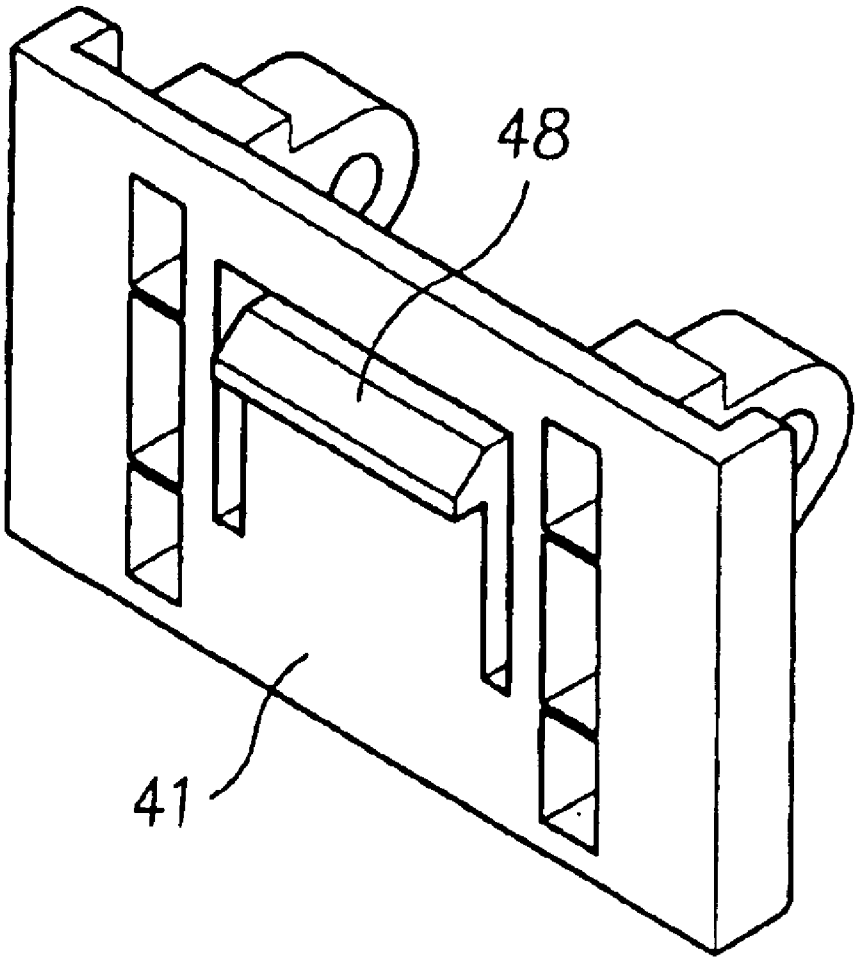
FIG. 2B is a perspective view of the anchoring block of FIG. 2A by viewing from a different direction.

As shown in FIG. 2A, the first embodiment of the present invention includes an anchoring block 40, a pivot 46 and an L-shape stand 20. The anchoring block 40 has a flat portion 41 with a positioning nose 48, as shown in FIG. 2B. Also, a pair of ear portions 42 are constructed at respective sides of the flat portion 41 of the anchoring block 40. Each of the ear portion 42 has a pivotal hole 44. As shown in FIG. 2A, a pair of rim fences 49 are included outside to the pair of the ear portion 42. The stand 20 has a pivotal pipe portion 24 formed at one side and a hook 22 formed at an opposite side. The pivot 46 is designed to pass through the pivotal hole 44 of the ear portion 42 of the anchoring block 40, the pivotal hole 44 of the pivotal pipe portion 24 of the stand 20, and the pivotal hole 44 of another ear portion 42 of the anchoring block 40. Upon such an arrangement, the stand 20 can rotate freely about the anchoring block 40. FIG. 1A shows the golf bag 10 posing an upright state, and the respective relationship between the base 18 of the golf bag 10 and the stand 20 is illustrated in FIG. 1B. At the upright state, the golf bag 10 can steadily stand on the ground by the flatness of the base 18 and the flat bottom surface of the L-shape stand 20.

Figure 1C:
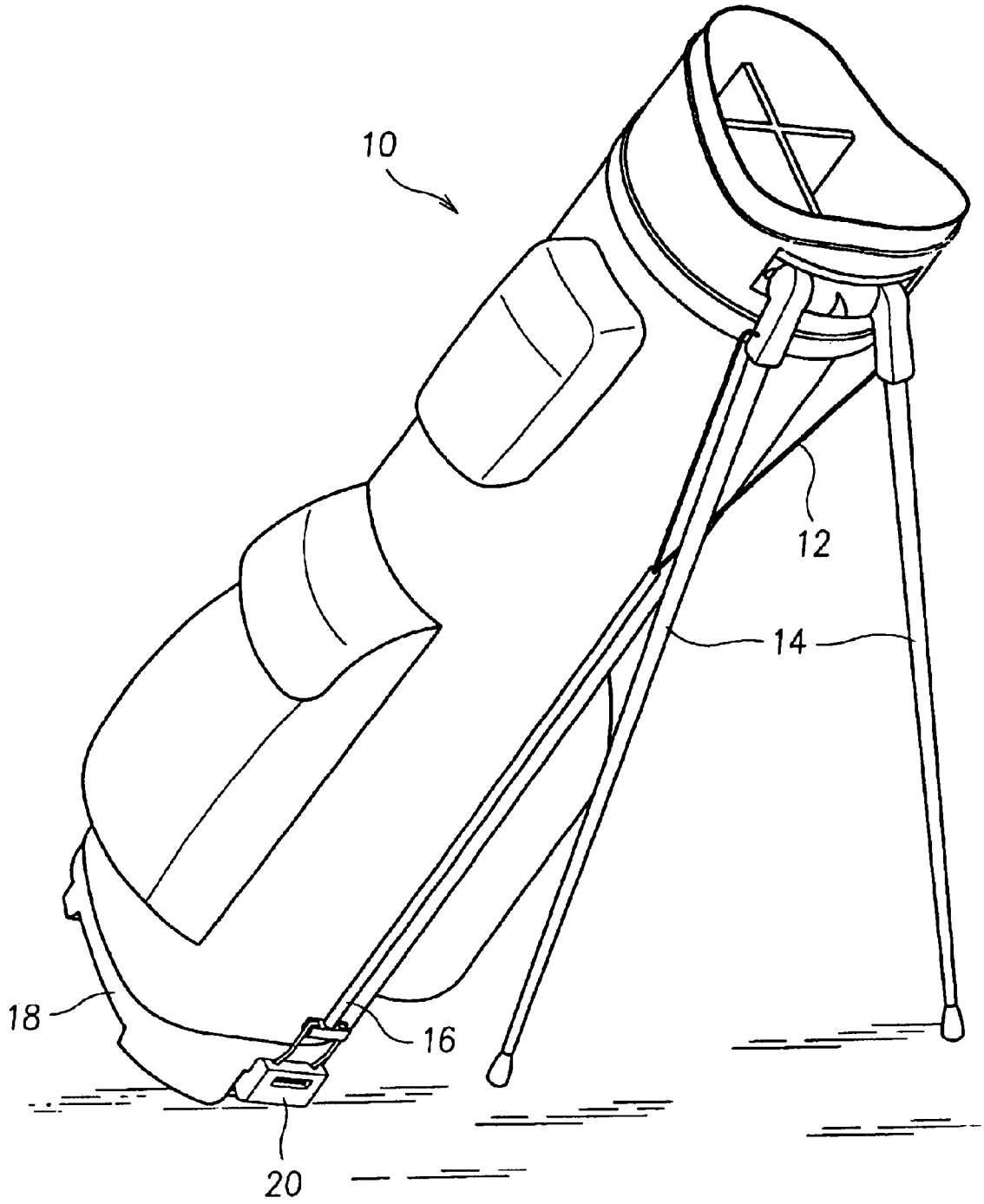
FIG. 1C is a perspective view of the golf bag of FIG. 1A, posing a slant position sustained by supporting frames.
Figure 1D:
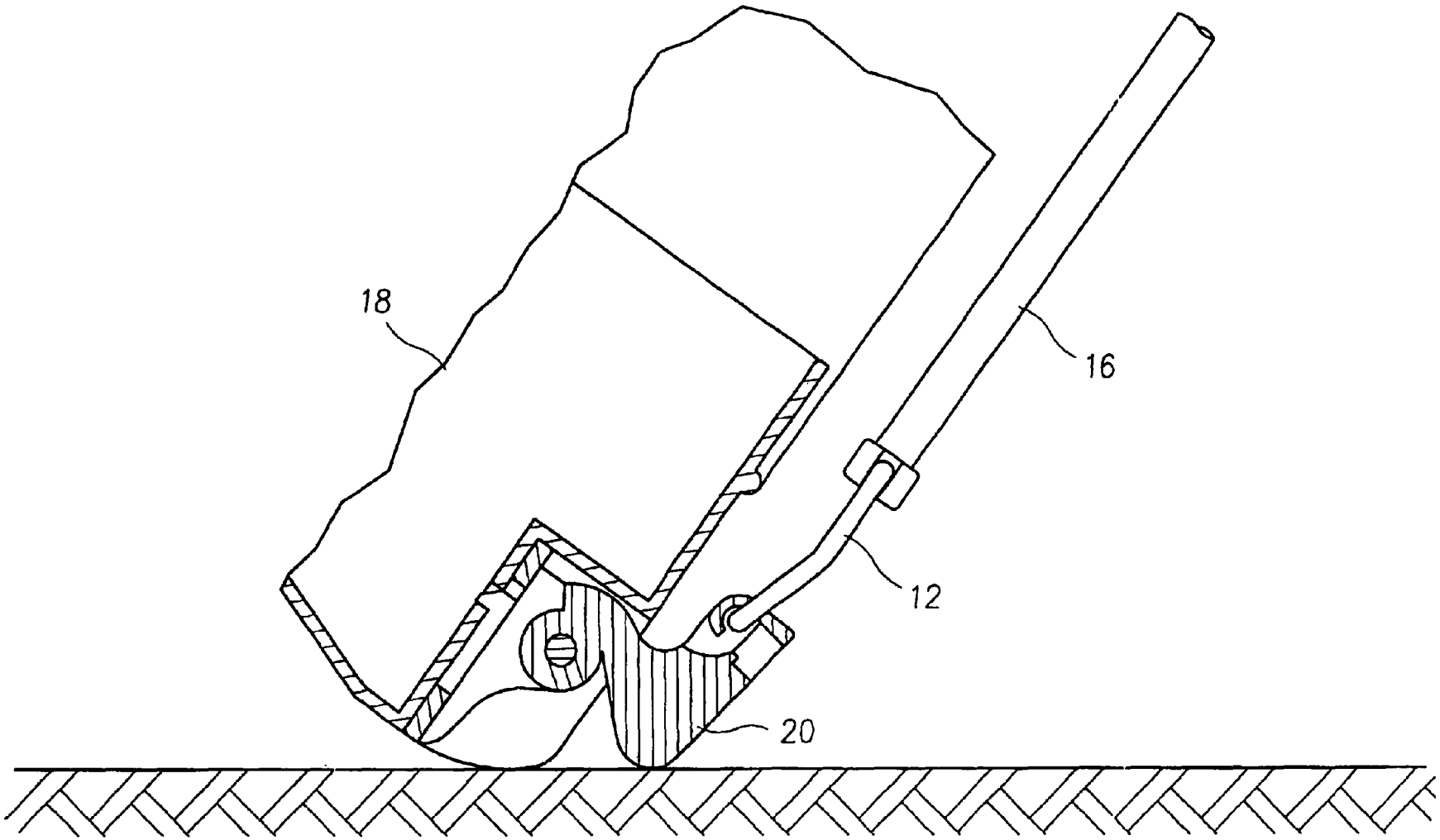
FIG. 1D is a partial cross-sectional view of FIG. 1C showing the lower portion of the golf bag.
Figure 3:
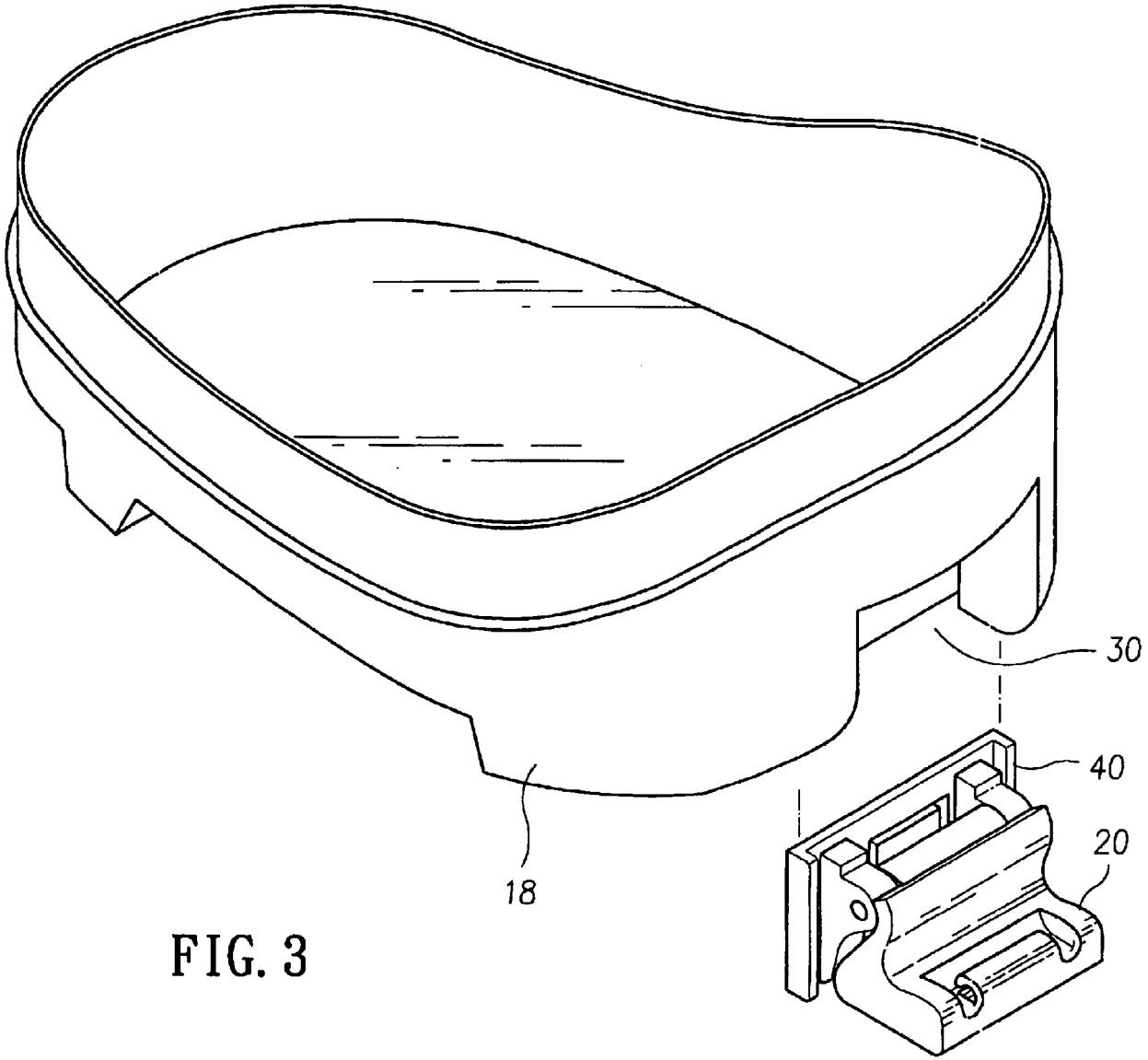
FIG. 3 is a perspective view of the stand of FIG. 2A with respect to a base of the golf bag.
Figure 4:
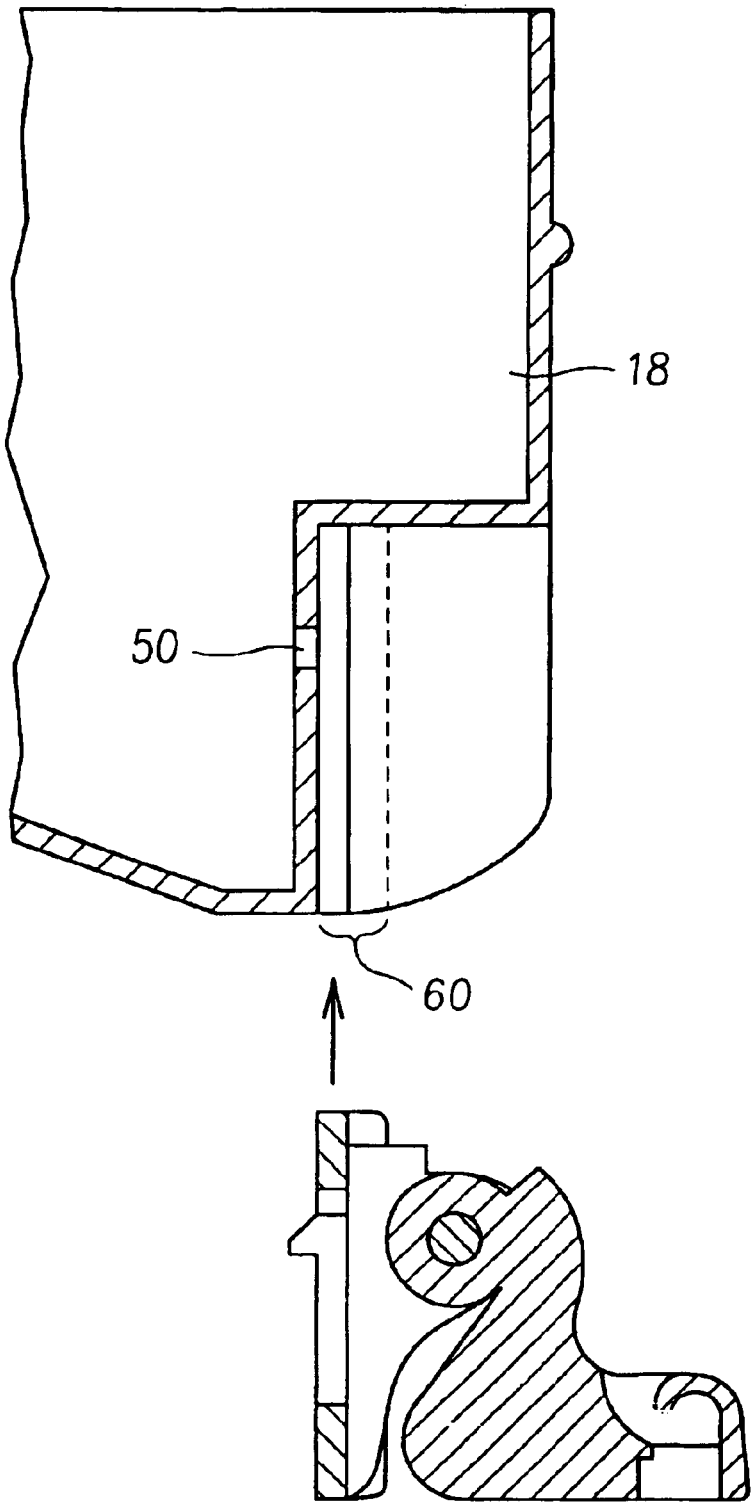
FIG. 4 is a partial cross-sectional view of FIG. 3.
Figure 5:
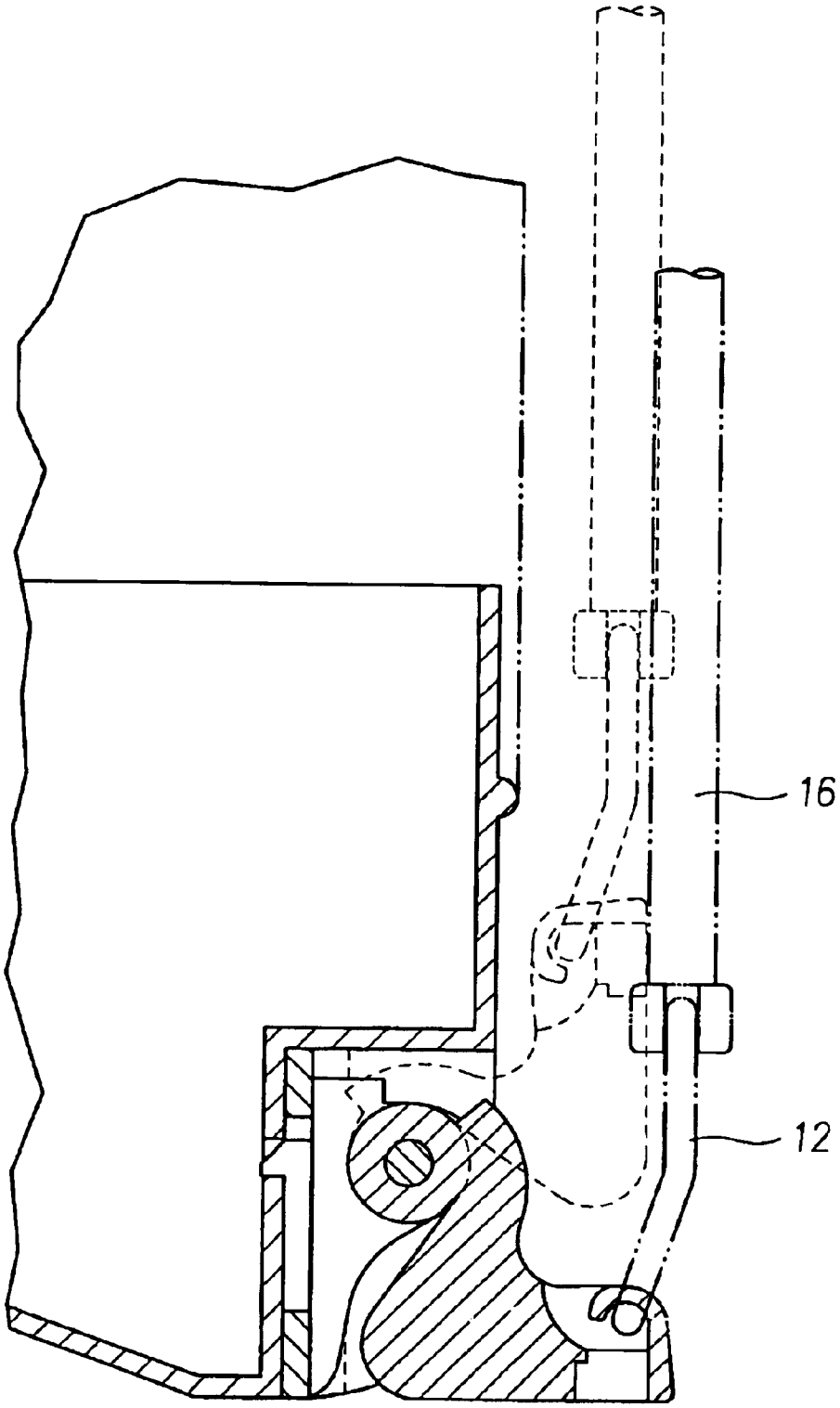
FIG. 5 is a partial cross-sectional view of the stand of FIG. 2A connecting with the based of the golf bag.

Referring to FIG. 3 through FIG. 5, the rim fences 49 forming sides of the anchoring block 40 as shown in FIG. 2A can mate, upwards and vertically, respectively with receiving grooves 60 formed at a vertical surface of the concave portion 30 of the base 18. By providing a positioning nose 48 of the anchoring block 40 to engage fixedly with an aperture 50 located at the vertical surface of the base 18, the stand 20 can thus fix with the base 18, and the link bar 12 can engage with the hook 22 of the stand 20. While in use, when the oblique legs 14 of the supporting frames are expanded to drive the link bar 12 and the stand 20 hooked with the link bar 12, a simultaneous grounding state as shown in FIG. 5, FIG. 1C and FIG. 1D is achieved by aligning an outer curve portion of the L-shape stand 20 with a resting surface of the base 18 of the golf bag 10.

Figure 6:
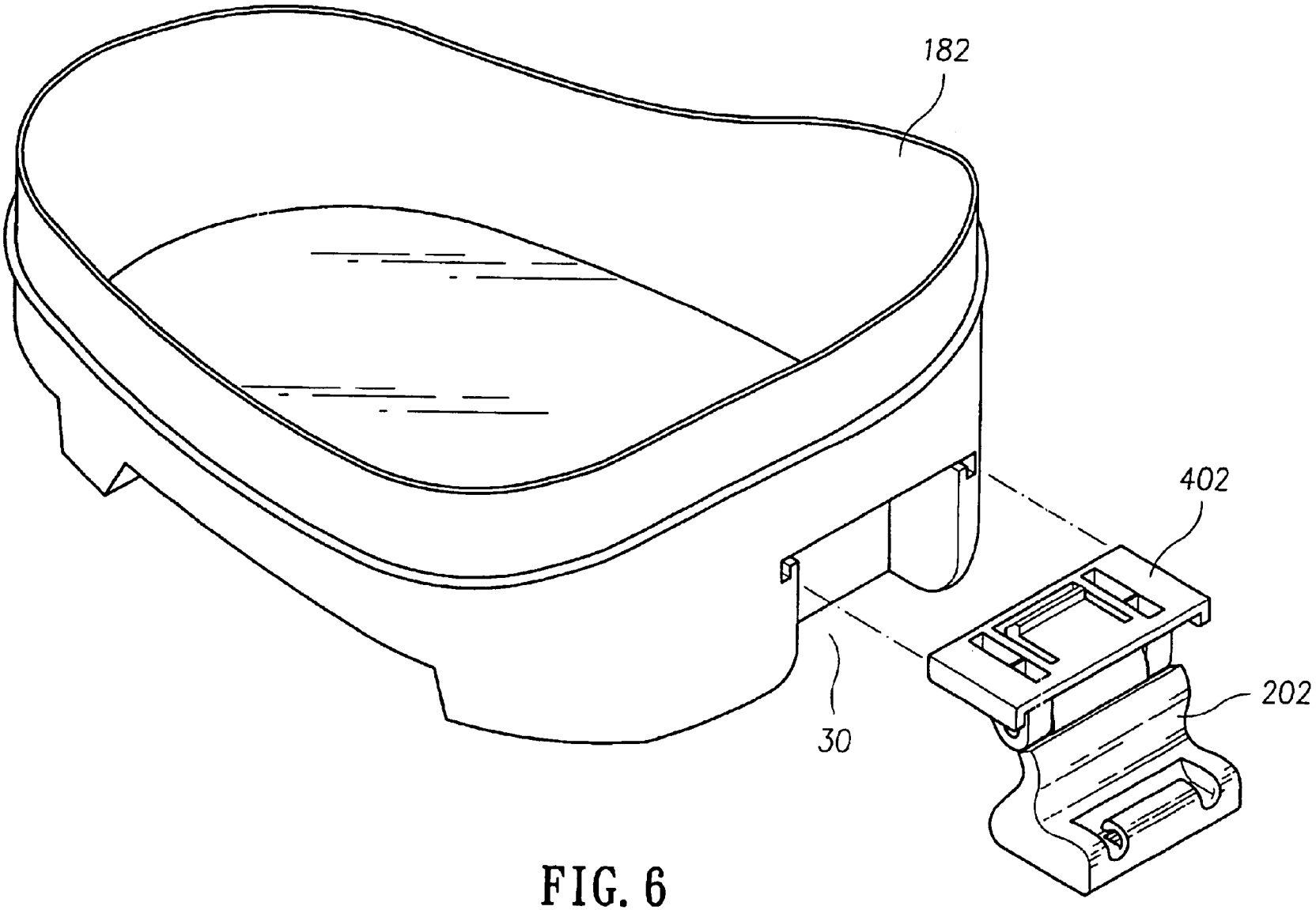
FIG. 6 is a perspective view of a second embodiment of the stand in accordance with the present invention, with respect to the base of the golf bag.
Figure 7:
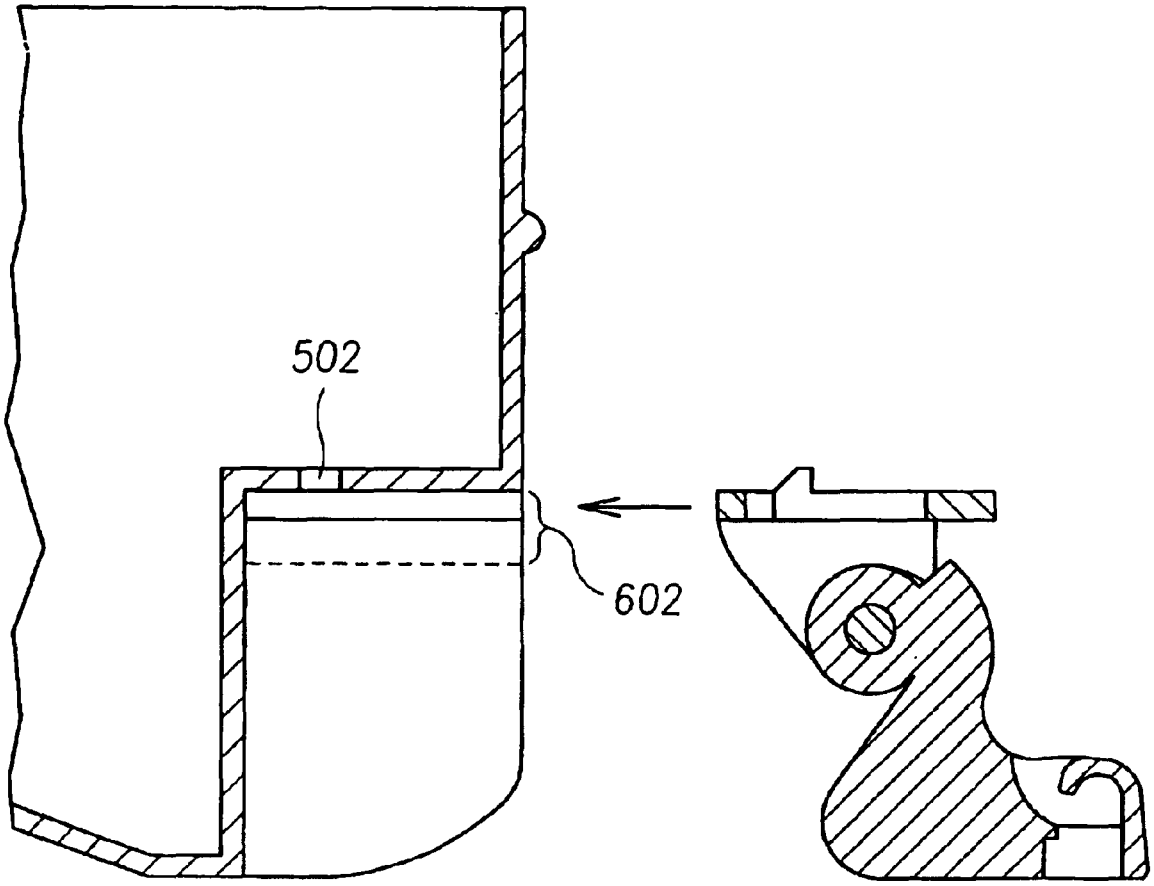
FIG. 7 is a partial cross-sectional view showing part of FIG. 6.
Figure 8:
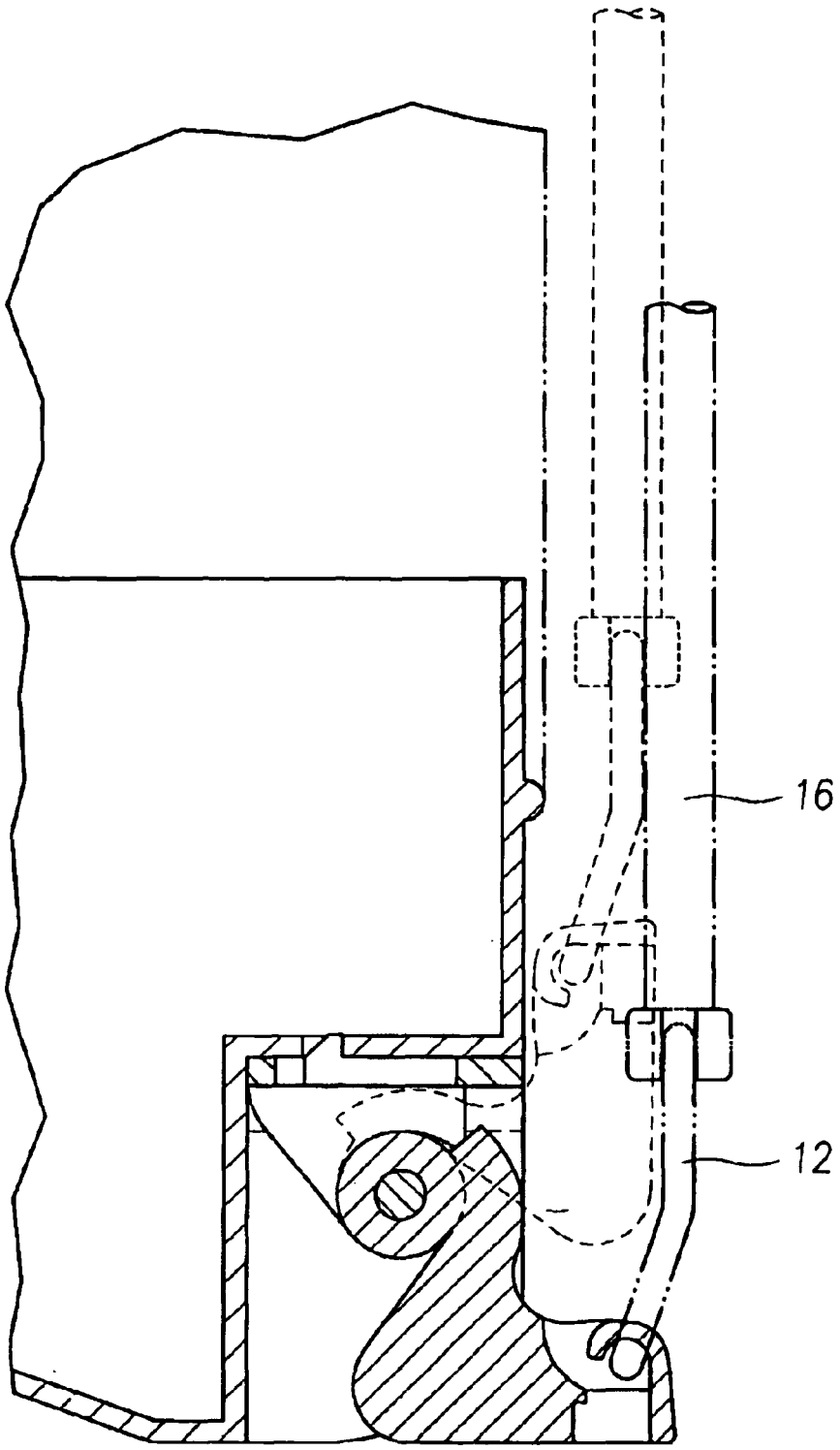
FIG. 8 is a partial cross-sectional view of the stand of FIG. 6 connecting with the base of the golf bag.

Referring now to FIG. 6 through FIG. 8, a second embodiment of the stand 202 for supporting frames of the golf bag in accordance with the present invention is shown. The second embodiment is similar, in structure, to the first embodiment described above, except that the rim fences 49 of the anchoring block 402 of the second embodiment can mate, inwards and horizontally, respectively with the receiving grooves 602 formed at a horizontal surface of the concave portion 30 of the base 182.

In the second embodiment of the present invention, the supporting frames, the anchoring block 402, and the stand 202 are almost identical in structure, respectively, to the supporting frames, the anchoring block 40, and the stand 20 of the first embodiment. However, the rim fences 49 at two sides of the anchoring block 402 can mate, inwards and horizontally, respectively with the receiving grooves 602 at two sides of the horizontal surface of the concave portion 30 of the base 182, as shown in FIG. 6 and FIG. 7. Also, by providing a positioning nose 48 of the anchoring block 402 to engage fixedly with an aperture 502 located at the horizontal surface of the base 182 as shown in FIG. 7 and FIG. 8, the stand 202 can thus fix with the base 182, and the link bar 12 can engage with the hook 22 of the stand 202. While in use, when the oblique legs 14 of the supporting frames are expanded to drive the link bar 12 and the stand 202 hooked with the link bar 12, a simultaneous grounding state as shown in FIG. 8 and FIG. 1C is achieved by aligning the outer curve portion of the L-shape stand 202 with a resting surface of the base 182 of the golf bag 10.

In the first and the second embodiments of the present invention, the engagement between the base 18' 182 and the stand 20' 202 as well as the anchoring block 40' 402 is achieved by pairing the positioning nose 48 and the aperture 50' 502. However, in a third and a fourth embodiments of the present invention described below, a screw set 54 for fastening the stand 20 and the anchoring block 40 to the base 18 is used.

Figure 9:
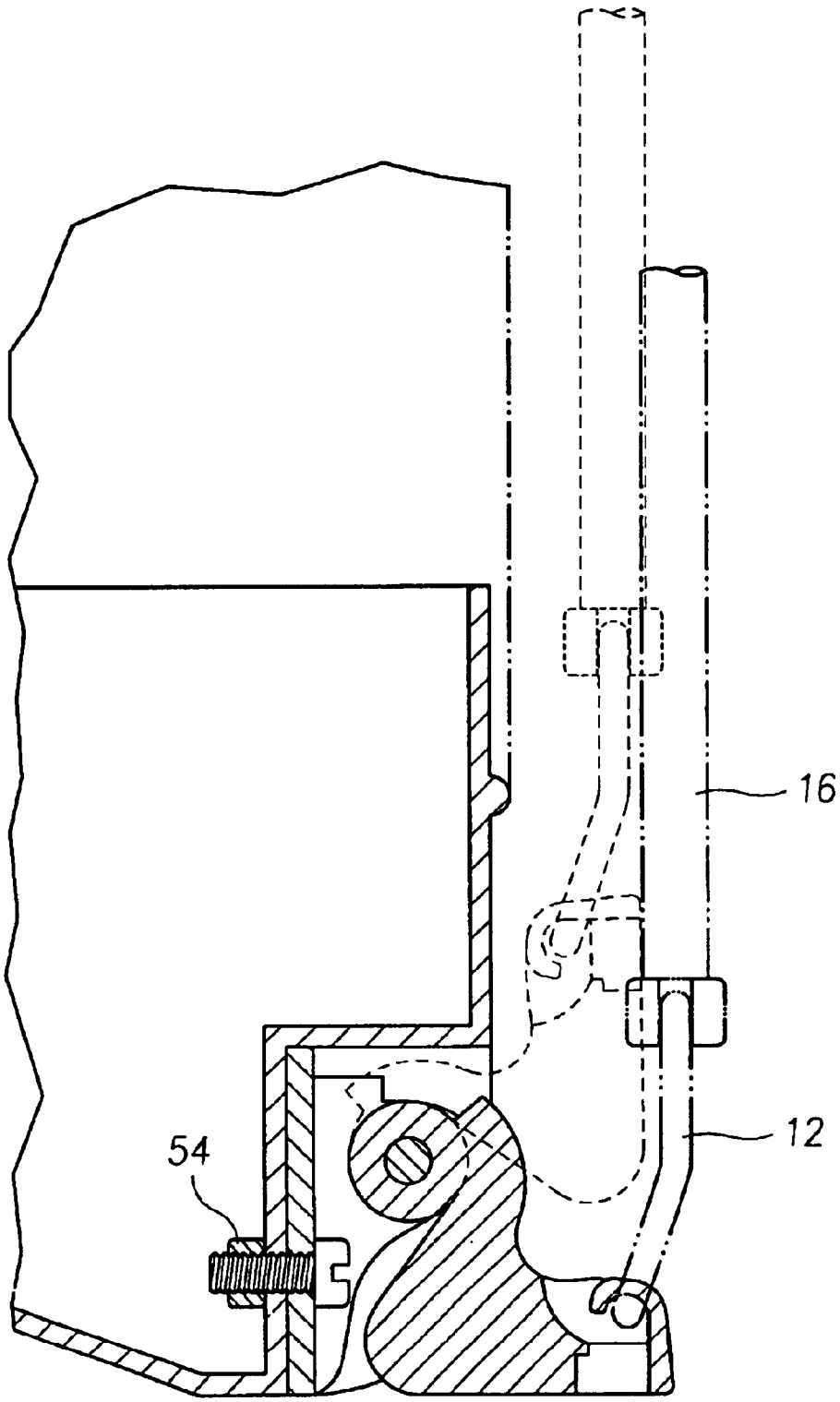
FIG. 9 is a partial cross-sectional view of a third embodiment of the stand in accordance with the present invention connecting with the base of the golf bag.

Referring now to FIG. 9, the third embodiment of the present invention is shown. In the third embodiment, the stand 20 and the supporting frames are the same, in structure, as those in the first embodiment. The anchoring block 40 for both embodiments is almost the same, except that the flat portion 41 of the third embodiment does not provide the positioning nose 48 but provides a hole corresponding to another hole located at the vertical surface of the concave portion 30 of the base 18. By providing the screw set 54 to pass through the hole at the flat portion 41 of the anchoring block 40 and the corresponding hole at the concave portion 30 of the base 18 so as to fasten the anchoring block 40 onto the vertical surface of the base 18, as shown in FIG. 9, the stand 20 can thus fix with the base 18, and the link bar 12 can engage with the hook 22 of the stand 20. While in use, when the oblique legs 14 of the supporting frames are expanded to drive the link bar 12 and the stand 202 hooked with the link bar 12, a simultaneous grounding state as shown in FIG. 8 and FIG. 16 is achieved by aligning the outer curve portion of the L-shape stand 202 with the resting surface of the base 18 of the golf bag 10.

Figure 10:
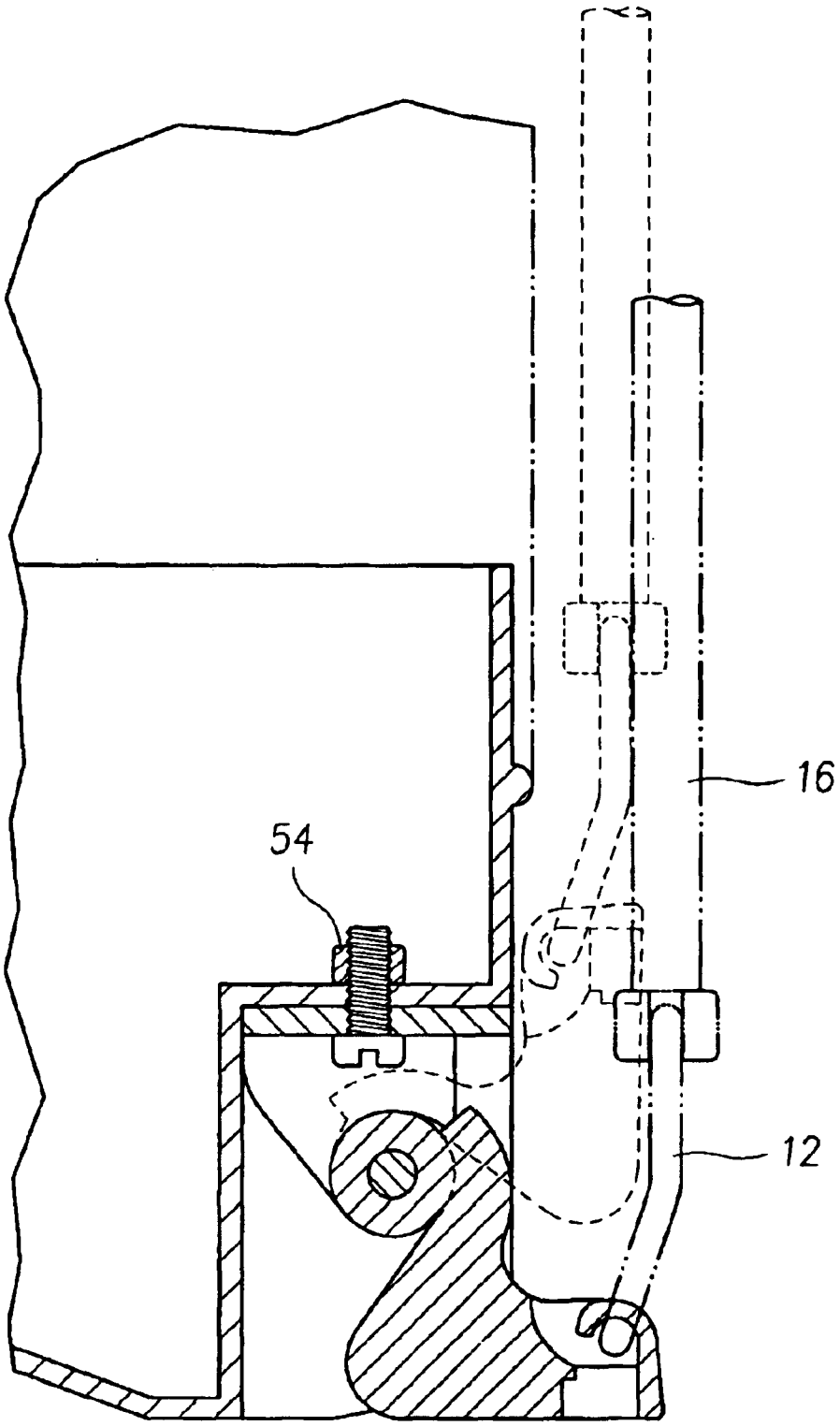
FIG. 10 is a partial cross-sectional view of a fourth embodiment of the stand in accordance with the present invention connecting with the base of the golf bag.

Referring now to FIG. 10, the fourth embodiment of the present invention is shown. The fourth embodiment is similar to the third embodiment described above, and major difference therebetween is that the horizontal surface of the concave portion 30 of the base in the fourth embodiment provides a hole corresponding to another bole located at the flat portion 41 of the anchoring block 40. By providing the screw set 54 to pass through the hole at the flat portion 41 of the anchoring block 40 and the corresponding hole at the concave portion 30 of the base 18, the anchoring block 40 can be fixed to the horizontal surface of the base 18.

In the fourth embodiment of the present invention, the supporting frames, the anchoring block 40 and the stand 20 are almost the same, in structure, as those in the third embodiment. However, the horizontal surface of the concave portion 30 of the base in the fourth embodiment provides a hole corresponding to another hole located at the flat portion 41 of the anchoring block 40. By providing the screw set 54 to pass through respectively the hole at, the flat portion 41 of the anchoring block 40 and the corresponding hole at the concave portion 30 of the base 18, the anchoring block 40 can thus be fixed to the horizontal surface of the base 18. Thereby, the stand 20 can thus fix with the base 18, and the link bar 12 can engage with the hook 22 of the stand 20. While in use, when the oblique legs 14 of the supporting frames are expanded to drive the link bar 12 and the stand 202 hooked with the link bar 12, a simultaneous grounding state as shown in FIG. 1C is achieved by aligning the outer curve portion of the L-shape stand 202 with the resting surface of the base 18 of the golf bag 10.

In various embodiments of the present invention, the supporting frames are preferably to include two oblique legs so that, while in use, the lower portion of the oblique legs can be co-planar with the outer curve portion of the L-shape stand, as shown in FIG. 1C. Also, it is noted that various embodiments upon the supporting frames are possible and can be used in the present invention.

While the present invention has been particularly shown and described with reference to a preferred embodiment, it will be understood by those skilled in the art that various changes in form and detail may be without departing from the spirit and scope of the present invention.

I claim:

1. A stand for supporting frames of a golf bag, pivotally constructed inside a concave portion formed at a rim of a base located at a lower portion of the golf bag; the supporting frames including a plurality of oblique legs, a connecting bar and a link bar, in which the connecting bar is a hollow-pipe structure for allowing the link bar to pass through thereinside and to stretch thereout at a top end thereof where the link bar forms as a fork shape for further connecting with respective top portions of the oblique legs; the top ends of the oblique legs being pivotally connected at a proper location at top of the golf bag;

characterized in that: the stand for supporting frames comprises an anchoring block, a pivot and an L-shape stand, the anchoring block having a flat portion with a positioning nose, the flat portion having a pair of ear portions constructed at opposite sides thereof, each of the ear portions having a pivotal hole, the flat portion having a pair of rim fences located respectively outside to the pair of the ear portions; the L-shape stand having a pivotal pipe portion formed at one side thereof and a hook formed at an opposite side thereof; the pivot passing through the pivotal hole of one said ear portion, the pivotal hole of the pivotal pipe portion, and the pivotal hole of another said ear portion so that the L-shape stand can rotate freely about the anchoring block, the rim fences of the anchoring block mating inwards and horizontally with respective receiving grooves formed at a horizontal surface of the concave portion thereby to have a positioning nose of the anchoring block engage fixedly with an aperture located at the horizontal surface so that the L-shape stand is fixed with the base and the link bar engages with the hook; while in use, when the oblique legs of the supporting frames being expanded to drive the link bar and the L-shape stand hooked with the link bar, a simultaneous grounding state can be achieved by aligning an outer curve portion of the L-shape stand with a resting surface of the base.

2. The stand for supporting frames of a golf bag according to claim 1, wherein said supporting frames include two oblique legs and lower ends of the oblique legs are co-planar with said outer curve portion of said L-shape stand while in said use.

3. A stand for supporting frames of a golf bag, pivotally constructed inside a concave portion formed at a rim of a base located at a lower portion of the golf bag; the supporting frames including a plurality of oblique legs, a connecting bar and a link bar, in which the connecting bar is a hollow-pipe structure for allowing the link bar to pass through thereinside and to stretch thereout at a top end thereof where the link bar forms as a fork shape for further connecting with respective top portions of the oblique legs; the top ends of the oblique legs being pivotally connected at a proper location at top of the golf bag;

characterized in that: the stand for supporting frames comprises an anchoring block, a pivot and an L-shape stand, the anchoring block having a flat portion with a hole, the flat portion having a pair of ear portions constructed at opposite sides thereof, each of the ear portions having a pivotal hole; the L-shape stand having a pivotal pipe portion formed at one side thereof and a hook formed at an opposite side thereof; the pivot passing though the pivotal hole of one said ear portion, the pivotal hole of the pivotal pipe portion, and the pivotal hole of another said ear portion so that the L-shape stand can rotate freely about the anchoring block; the concave portion having a vertical surface including a hole corresponding to the hole of the flat portion; a screw set being used to pass through the hole of the flat portion and the corresponding hole of the concave portion so as to have the anchoring block engage fixedly onto the vertical surface so that the L-shape stand is fixed with the base and the link bar engages with the hook; while in use, when the oblique legs of the supporting frames being expanded to drive the link bar and the L-shape stand hooked with the link bar, a simultaneous grounding state can be achieved by aligning an outer curve portion of the L-shape stand with a resting surface of the base.

4. The stand for supporting frames of a golf bag according to claim 3, wherein said supporting frames include two oblique legs and lower ends of the oblique legs are co-planar with said outer curve portion of said L-shape stand while in said use.

5. A stand for supporting frames of a golf bag, pivotally constructed inside a concave portion formed at a rim of a base located at a lower portion of the golf bag; the supporting frames including a plurality of oblique legs, a connecting bar and a link bar, in which the connecting bar is a hollow-pipe structure for allowing the link bar to pass through thereinside and to stretch thereout at a top end thereof where the link bar forms as a fork shape for further connecting with respective top portions of the oblique legs; the top ends of the oblique legs being pivotally connected at a proper location at top of the golf bag;

characterized in that: the stand for supporting frames comprises an anchoring block, a pivot and an L-shape stand, the anchoring block having a flat portion with a hole, the flat portion having a pair of ear portions constructed at opposite sides thereof, each of the ear portions having a pivotal hole; the L-shape stand having a pivotal pipe portion formed at one side thereof and a hook formed at an opposite side thereof; the pivot passing through the pivotal hole of one said ear portion, the pivotal hole of the pivotal pipe portion, and the pivotal hole of another said ear portion so that the L-shape stand can rotate freely about the anchoring block; the concave portion having a horizontal surface including a hole corresponding to the hole of the flat portion; a screw set being used to pass though the hole of the flat portion and the corresponding hole of the concave portion so as to have the anchoring block engage fixedly onto the horizontal surface so that the L-shape stand is fixed with the base and the link bar engages with the hook; while in use, when the oblique legs of the supporting frames being expanded to drive the link bar and the L-shape stand hooked with the link bar, a simultaneous grounding state can be achieved by aligning an outer curve portion of the L-shape stand with a resting surface of the base.

6. The stand for supporting frames of a golf bag according to claim 5, wherein said supporting frames include two oblique legs and lower ends of the oblique legs are co-planar with said outer curve portion of said L-shape stand while in said use.

* * * * *